US006905442B1

(12) United States Patent
Lee et al.

(10) Patent No.: US 6,905,442 B1
(45) Date of Patent: Jun. 14, 2005

(54) ELLIPTICAL EXERCISING APPARATUS

(75) Inventors: Sunny Lee, No. 48-20, Ching-Chai Lane, Nan-Pu Li, Tsao-Tun Chen, Nan-Tou Hsien (TW); Simon Chao, Nan-Tou Hsien (TW)

(73) Assignee: Sunny Lee, (TW)

( * ) Notice: Subject to any disclaimer, the term of this patent is extended or adjusted under 35 U.S.C. 154(b) by 0 days.

(21) Appl. No.: 10/768,627

(22) Filed: Jan. 29, 2004

(51) Int. Cl.[7] ..... A63B 69/16; A63B 22/04
(52) U.S. Cl. ..... 482/52; 482/51
(58) Field of Search ..... 482/51, 52, 57, 482/70, 79–80

(56) References Cited

U.S. PATENT DOCUMENTS 5,762,588 A * 6/1998 Chen ..... 482/57
5,799,599 A * 9/1998 Tsukioka et al. ..... 112/65
6,007,462 A * 12/1999 Chen ..... 482/57
6,302,825 B1 * 10/2001 Stearns et al. ..... 482/52
6,450,925 B1 * 9/2002 Kuo ..... 482/52
6,672,992 B1 * 1/2004 Lo et al. ..... 482/52
6,719,666 B1 * 4/2004 Lo et al. ..... 482/52
6,726,600 B2 * 4/2004 Miller ..... 482/51

* cited by examiner

*Primary Examiner*—Stephen R. Crow
(74) *Attorney, Agent, or Firm*—Ostrolenk, Faber, Gerb & Soffen, LLP

(57) ABSTRACT

An elliptical exercising apparatus includes a main frame having base and upstanding supports, two handles connected pivotally and respectively to opposite sides of the upstanding support, two rocker arms connected respectively to the handles, two pedal members mounted slidably and respectively on a pair of pedal axles, and two connecting arms. A crank assembly is mounted on a rear end portion of the base support. Each rocker arm has upper and lower connection parts. Each pedal axle has front and rear ends connected pivotally and respectively to the upper connection part and the crank assembly. Each connecting arm has front and rear ends connected respectively to the lower connection part and a corresponding pedal member.

4 Claims, 6 Drawing Sheets

ELLIPTICAL EXERCISING APPARATUS

BACKGROUND OF THE INVENTION

1. Field of the Invention

The invention relates to an exercising apparatus, more particularly to an elliptical exercising apparatus.

2. Description of the Related Art

Referring to FIG. 1, a conventional elliptical exercising apparatus is shown to comprise a main frame 1, a crank assembly 2, two handle assemblies 3, and two pedal assemblies 4. The main frame 1 includes a base support 101 disposed on the ground, and an upstanding support 102 mounted on a front end portion of the base support 101. The crank assembly 2 includes a crank wheel 201 connected pivotally to a rear end portion of the base support 101, and two crank members 202 connected pivotally and respectively to two opposite sides of the crank wheel 201. The handle assemblies 3 are connected pivotally and respectively to two opposite sides of the upstanding support 102. Each of the pedal assemblies 4 includes a pedal axle 401 and a pedal member 402. The pedal axle 401 has a front end connected pivotally to a bottom end of a corresponding handle assembly 3, and a rear end connected pivotally to a corresponding crank member 202. The pedal member 402 is mounted fixedly on the respective pedal axle 401.

In use, the user steps on the pedal members 402 with two hands grasping respectively the top ends of the handle assemblies 3. Then, through coordination of the swinging movement of the handle and pedal assemblies 3, 4, an exercise simulating a striding movement is effected.

However, since the pedal members 402 are fixed respectively on the pedal axles 401, the pedal members 402 can only move along with the pedal axles 401. The pedal axles 401 are, in turn, connected pivotally and respectively to the handle assemblies 3 and the crank members 202, so that movement of the pedal members 402 are limited by the crank members 202 and so that the largest front-to-rear distance that can be traveled by the pedal members 402 is roughly equal to the sum of the lengths of the two crank members 202. As such, the stepping distance between the user's feet is limited such that the user's leg muscles cannot be stretched fully. Furthermore, if the length of each crank member 202 is increased so as to obtain a larger stepping distance, the body structure of the conventional elliptical exercising apparatus is also increased, thereby making assembly, storage, and use of the apparatus inconvenient.

SUMMARY OF THE INVENTION

Therefore, the object of the present invention is to provide an elliptical exercising apparatus that is capable of overcoming the aforementioned drawbacks of the prior art.

According to this invention, an elliptical exercising apparatus comprises a main frame, a crank assembly, two handles, two rocker arms, two pedal axles, two pedal members, and two connecting arms. The main frame has a base support adapted to be disposed on the ground, and an upstanding support extending upright from a front end portion of the base support. The crank assembly includes a crank wheel connected rotatably to a rear end portion of the base support, and two crank members connected respectively to two opposite sides of the crank wheel. The handles are connected pivotally and respectively to two opposite sides of the upstanding support. The rocker arms are connected respectively to the handles. Each of the rocker arms has upper and lower connection parts. Each of the pedal axles has a front end connected pivotally to the upper connection part of a corresponding one of the rocker arms, and a rear end connected to a corresponding one of the crank members. Each of the pedal members is mounted slidably on a corresponding one of the pedal axles. Each of the connecting arms has a front end connected to the lower connection part of a corresponding one of the rocker arms, and a rear end connected to a corresponding one of the pedal members.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
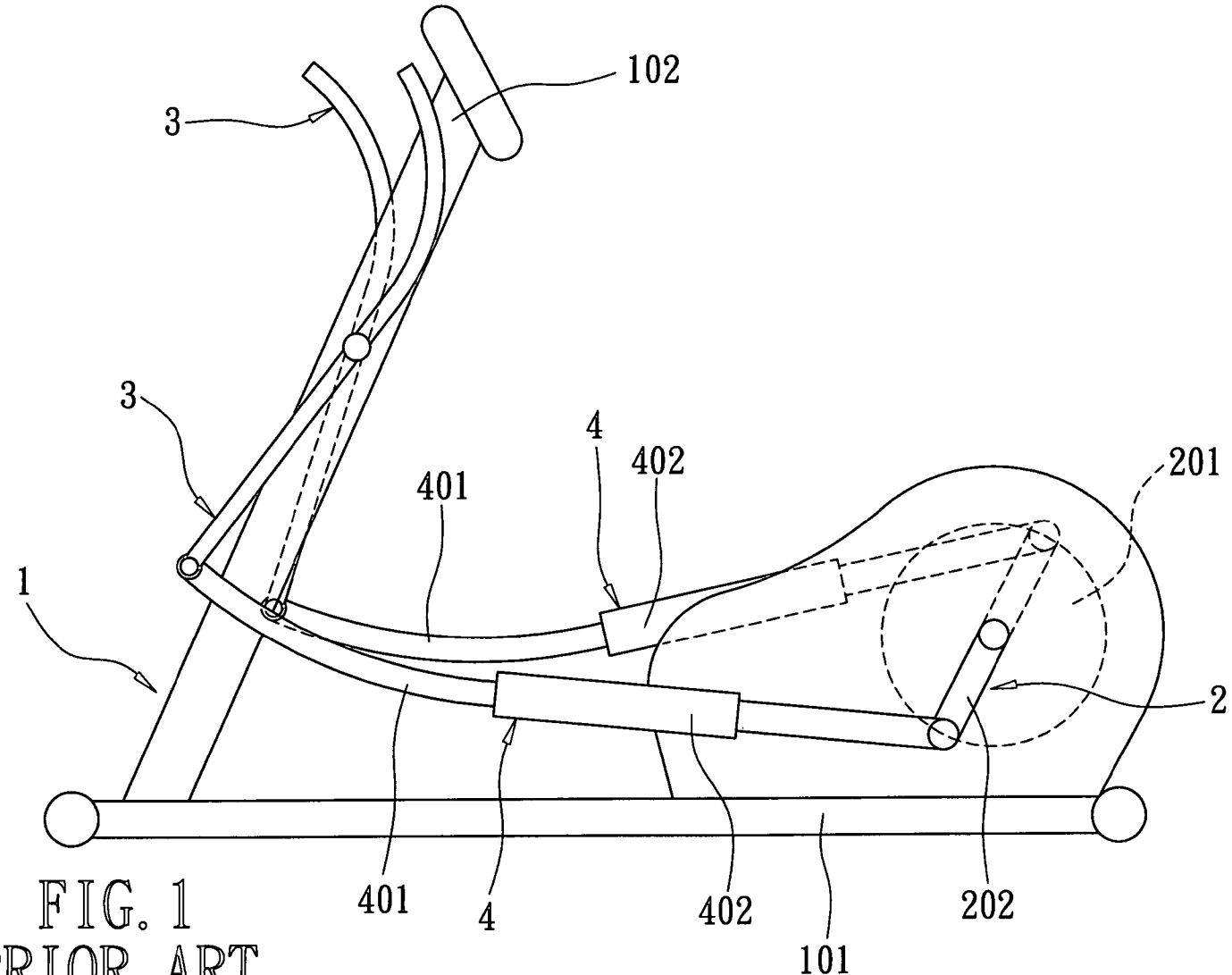
FIG. 1 PRIOR ART
FIG. 1 is a schematic side view of a conventional elliptical exercising apparatus.
Figure 2:
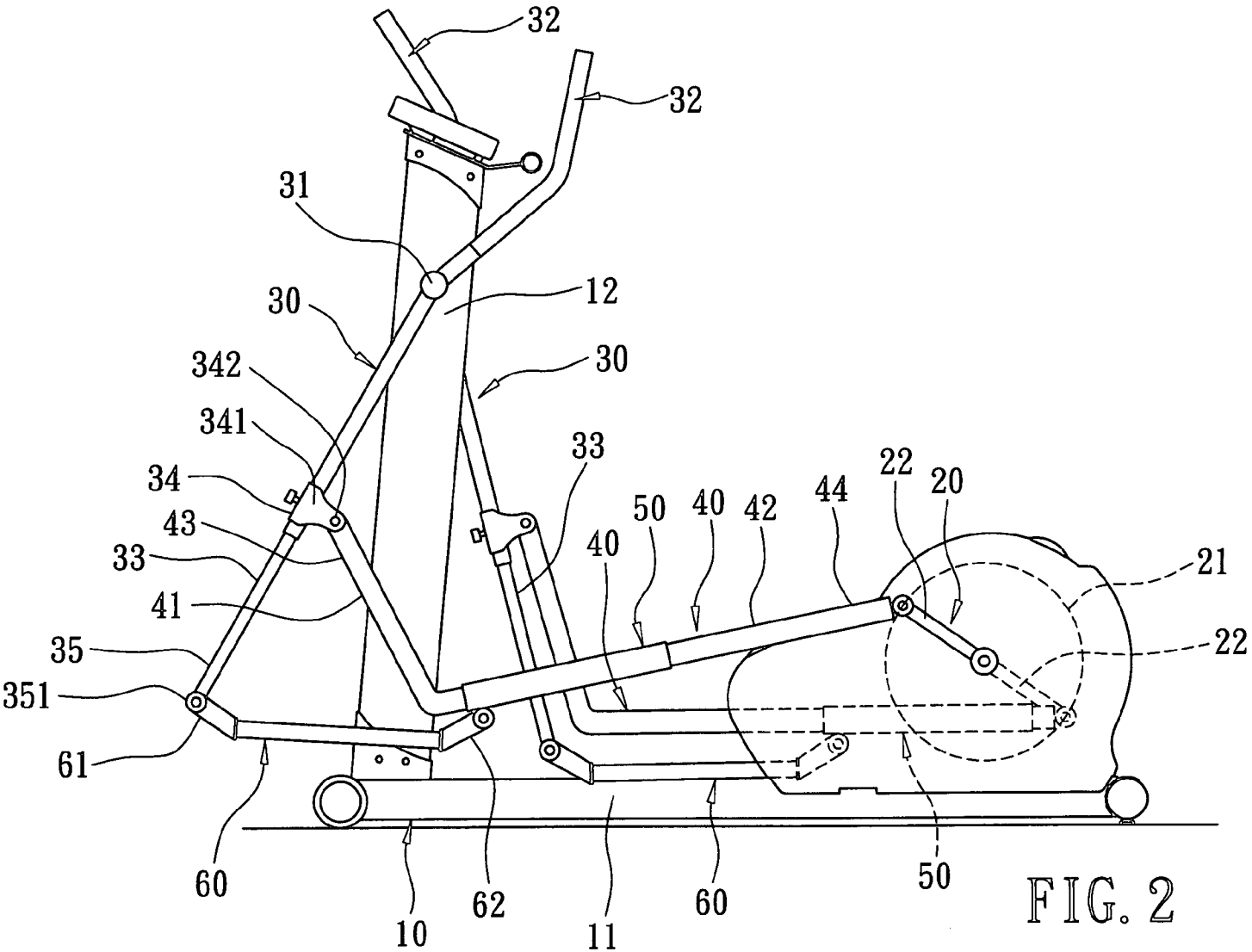
FIG. 2 is a schematic side view of the preferred embodiment of an elliptical exercising apparatus according to the present invention.

Referring to FIG. 2, the preferred embodiment of an elliptical exercising apparatus according to the present invention is shown to comprise a main frame 10, a crank assembly 20, two handles 32, two rocker arms 30, two pedal axles 40, two pedal members 50, and two connecting arms 60.

The main frame 10 has a base support 11 adapted to be disposed on the ground, and an upstanding support 12 extending upright from a front end portion of the base support 11. The main frame 10 is substantially similar to the main frame 1 of the aforementioned conventional elliptical exercising apparatus so that a detailed description of the same will be dispensed herewith for the sake of brevity.

The crank assembly 20 includes a crank wheel 21 connected rotatably to a rear end portion of the base support 11, and two crank members 22 connected pivotally and respectively to two opposite sides of the crank wheel 21. The crank assembly 20 is substantially similar to the aforementioned crank assembly 2 of the conventional elliptical exercising apparatus so that a detailed description of the same will be dispensed herewith for the sake of brevity.

The handles 32 are connected pivotally and respectively to two opposite sides of the upstanding support 12 via a pivot member 31.

The rocker arms 30 are connected respectively to the handles 32. Each of the rocker arms 30 has an upper connection part 34, and a lower connection part 35 opposite to the upper connection part 34. The upper connection part 34 has a fixed connection plate 341 with a pivot member 342. The lower connection part 35 has a pivot member 351. Each of the rocker arms 30 is telescopic, and has are tractable and extensible section 33 extending from the upper connection part 34 to the lower connection part 35.

The pedal axles 40 are disposed respectively on two opposite sides of the base support 11. Each of the pedal axles 40 has a front end 43 connected pivotally to the connection plate 341 on the upper connection part 34 of a corresponding one of the rocker arms 30, and a rear end 44 connected to a corresponding one of the crank members 22. Each pedal axle 40 has a front section 41 and a rear section 42 connected to and forming an angle with the front section 41.

Each of the pedal members 50 is mounted slidably on the rear section 42 of a corresponding one of the pedal axles 40.

The connecting arms 60 are disposed respectively on the two opposite sides of the base support 11. Each of the connecting arms 60 has a front end 61 connected pivotally to the pivot member 351 on the lower connection part 35 of a corresponding one of the rocker arms 30, and a rear end 62 connected pivotally to a corresponding one of the pedal members 50.

Figure 3:
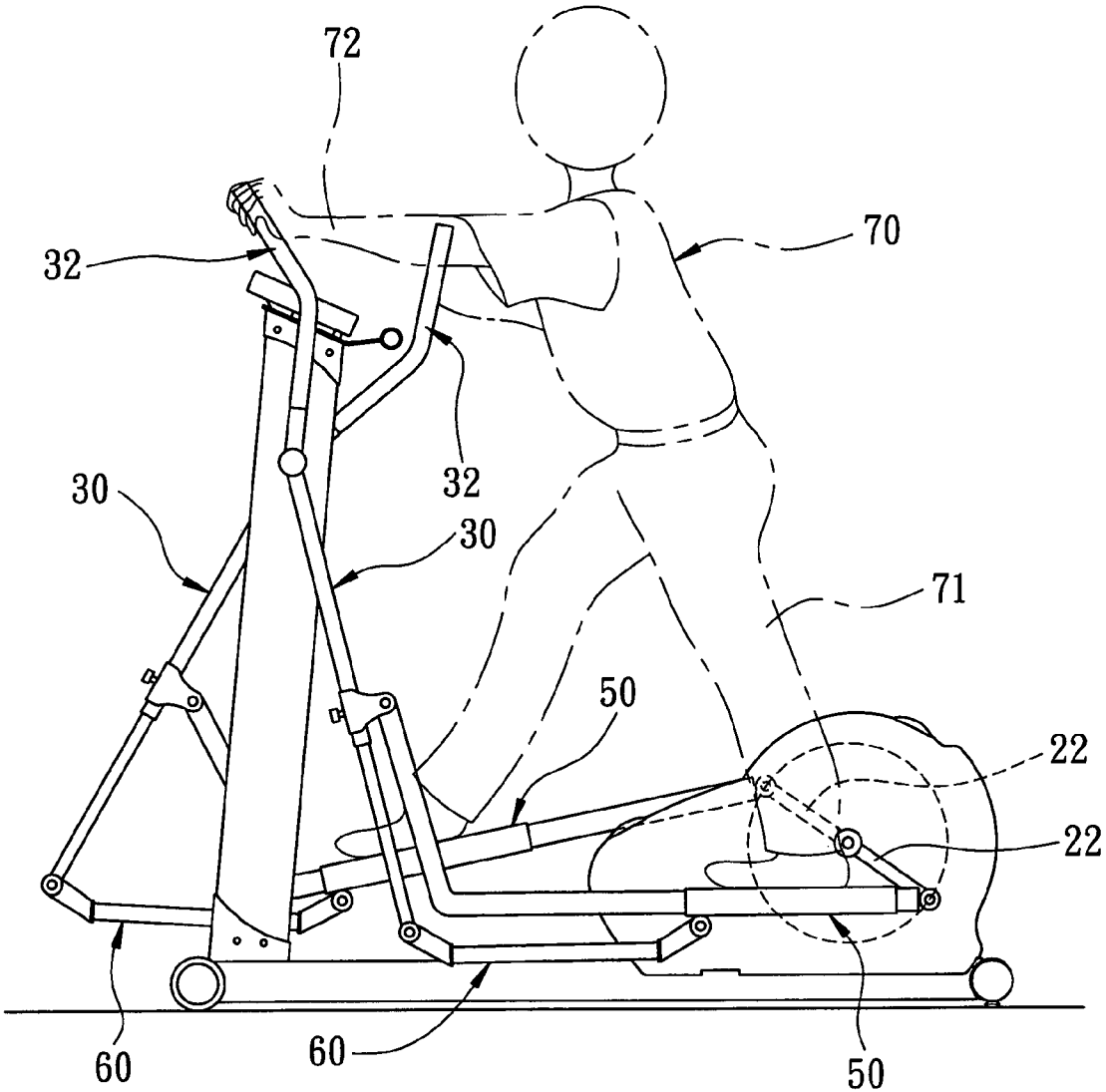
FIG. 3 illustrates the elliptical exercising apparatus of the present invention in a state of use.

Referring to FIG. 3, when the present invention is in use, the feet 71 of the user 70 step respectively on the pedal members 50, and the hands 72 of the user 70 grasp respectively the handles 32. Through coordination of the swinging movement of the handles 32, the annular movement of the crank members 22, and frontward and rearward sliding movement of the pedal members 50 brought along by movement of the connecting arms 60, an exercise simulating a striding movement is effected.

Figure 4:
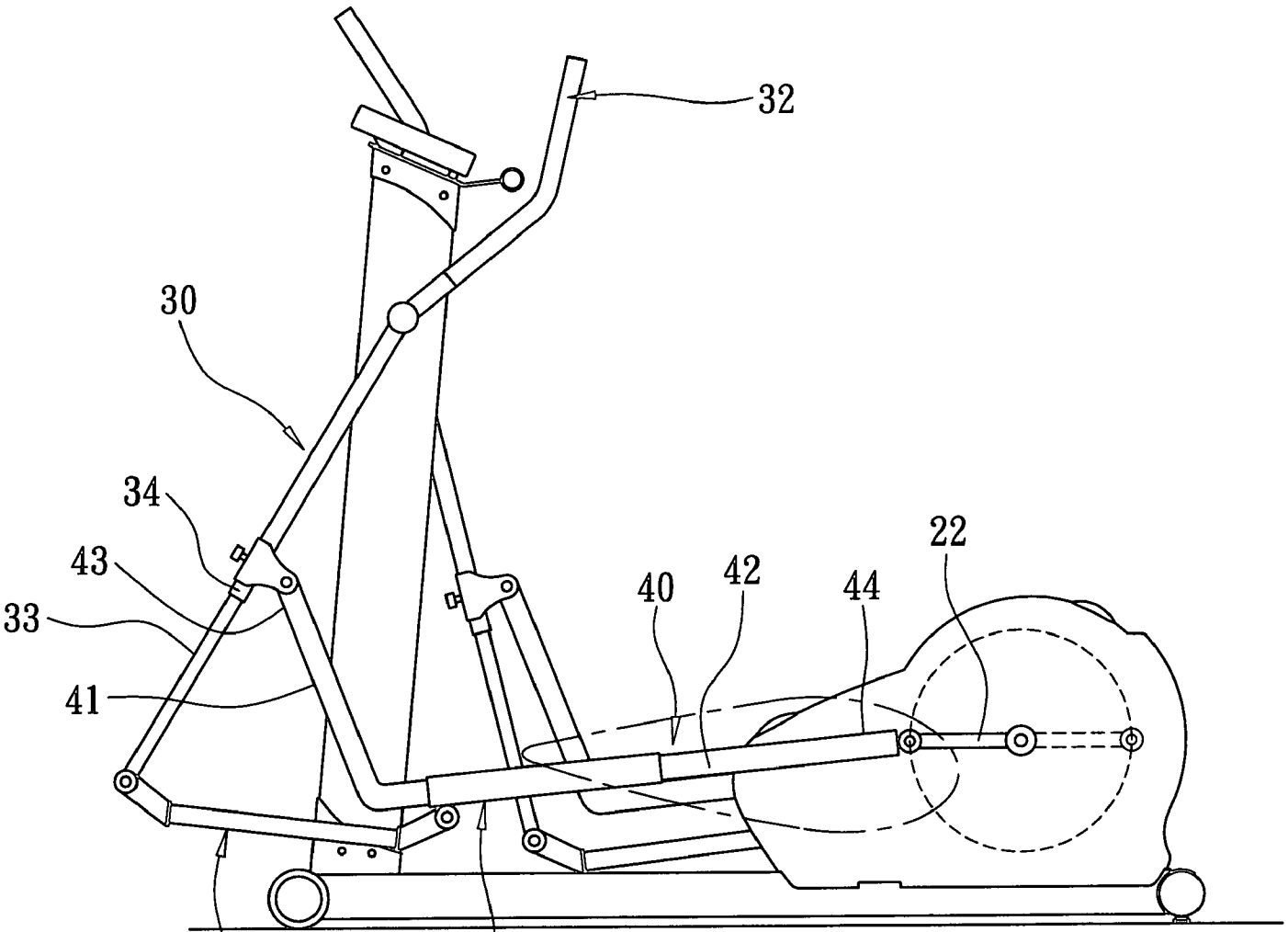
FIG. 4 illustrates how a pedal member slides toward a front section of a pedal axle when a handle is pulled rearwardly.

Referring to FIG. 4, when the user 70 (see FIG. 3) pulls one of the handles 32 toward his body, the telescopic section 33 of the rocker arm 30 will move away from the user's body, bringing along the connecting arm 60, which in turn pulls the pedal member 50 to slide along the rear section 42 of the pedal axle 40 toward a location proximate to the front section 41. At the same time, the upper connection part 34 of the rocker arm 30 moves frontwardly bringing along the pedal axle 40 and the crank member 22.

Figure 5:
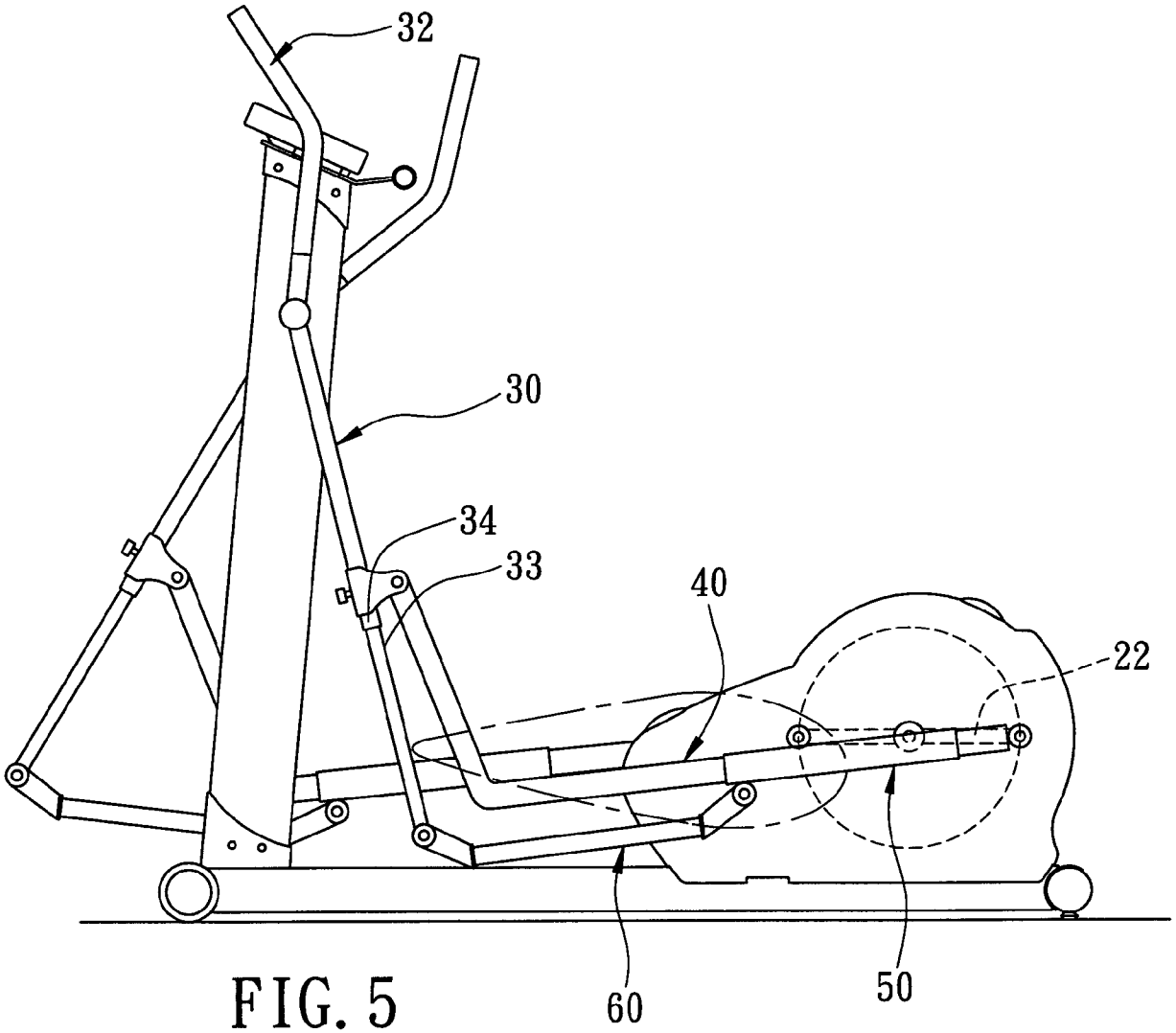
FIG. 5 illustrates how the pedal member slides toward a rear section of the pedal axle when the handle is pushed frontwardly.

When the user 70 pushes one of the handles 32 away from his body, the telescopic section 33 of the rocker arm 30 will move toward the user's body and pushes the connecting arm 60, which in turn pushes the pedal member 50 to slide toward the rear end 44 of the pedal axle 40. Simultaneously, the upper connection part 34 of the rocker arm 30 pushes the pedal axle 40 and the crank member 22 to move rearwardly, as shown in FIG. 5. As such, through alternate push-pull action on the handles 30 by the hands 72 of the user 70, the crank members 22 produce a continuous rotation so that the pedal members 50 move alternately in elliptical motions following a pointed-front and rounded-rear outline. Thus, the feet 71 of the user 70 will naturally stretch frontward and rearward, effecting a striding exercise.

Referring back to FIG. 2, since the pedal members 50 slide along the respective pedal axles 40 and are moved by the connecting arms 60, the pedal members 50 will not be limited by the crank members 22, but will move along with the connecting arms 60. The front-to-rear distance that can be traveled by the pedal members 50 is determined by the distance between the lower connection parts 35 of the rocker arms 30, and not by the lengths of the crank members 22.

Figure 6:
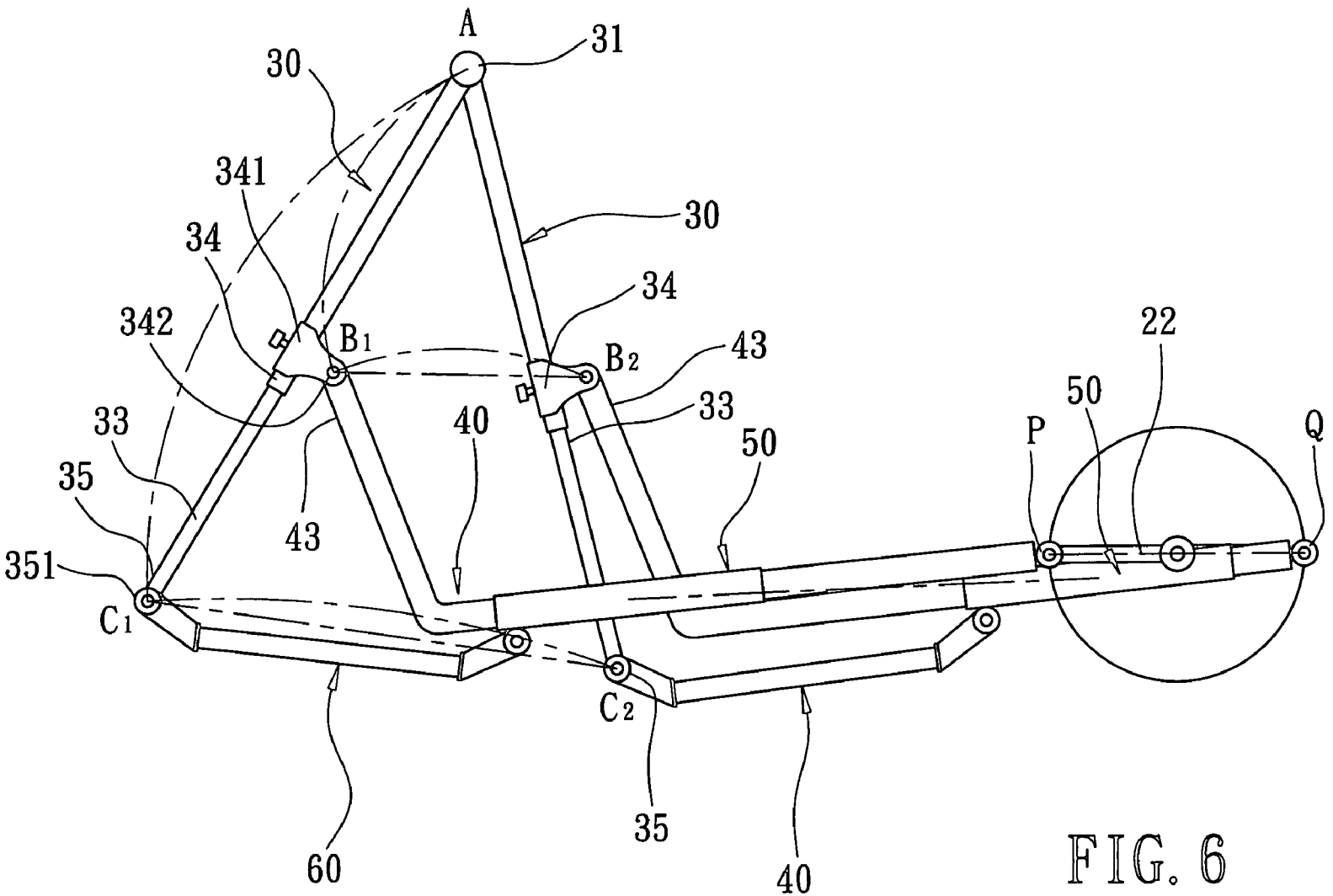
FIG. 6 illustrates distance relations between the pedal axles and the pedal members.

Referring to FIG. 6, the connecting point of the rocker arms 30 and the upstanding support 12 is defined as point A, the pivot connecting points of the upper connection parts 34 and the front end 43 of the pedal axles 40 are respectively defined as points $B_1$ and $B_2$, and the pivot connecting points of the lower connection parts 35 of the rocker arms 30 and the connecting arms 60 are respectively defined as points $C_1$ and $C_2$. A triangle is defined by line $AC_1$, line $C_1C_2$, and line $AC_2$. Particularly, the ratio of the length of the rocker arm 30 (i.e., the length from point A to point $C_1$) to the length measured from the pivot member 31 to the upper connection part 34 (i.e., the length from point A to point $B_1$) is proportionately equal to the ratio of the distance between the lower connection parts 35 (i.e., the distance from point $C_1$ to point $C_2$) to the distance between the upper connection parts 34 (i.e., the distance from point $B_1$ to point $B_2$). Since the pedal axle 40 is connected pivotally and respectively to the upper connection part 34 and an end of the crank member 22, the distance between the ends (P, Q) of the two crank members 22 is substantially equal to the distance between point $B_1$ to point $B_2$ of the upper connection parts 34. The distance from point $B_1$ to point $B_2$ will thus be limited by the crank members 22 so that the largest distance from point $B_1$ to point $B_2$ will be equal to the total length of the two crank members 22. At this time, if the length from point A to point $C_1$ is equal to twice the length from point A to point $B_1$, then, the largest distance between point $C_1$ to point $C_2$ will be equal to twice the largest distance between point $B_1$ to point $B_2$ (i.e., equal to the length of four crank members 22), so that the largest front-to-rear distance that can be traveled by the pedal members 50, i.e., the striding distance of the user 70, is four times the length of each crank member 22. Furthermore, since each rocker arm 30 has a retractable and extensible section 33, its length can be adjusted. Through the presence of the retractable and extensible section 33, the ratio of the length of the rocker arm 30 to the length measured from the pivot member 31 to the upper connection part 34 can be altered, which in turn can control the swinging amplitude of the connecting arms 60, thereby achieving adjustment of the striding distance of the user 70.

It should be noted that even if the length of each rocker arm 30 is kept unchanged, the striding distance of the user 70 can be adjusted by changing locations of the pivot connecting points of the rocker arms 30 with the corresponding pedal axles 40.

Therefore, the elliptical exercising apparatus of the present invention does not require changing of the lengths of the crank members 22 to cope with the desired striding distance of the user 70. Through cooperation of the rocker arms 30, the pedal axles 40, the pedal members 50, and the connecting arms 60, the striding distance between the feet 71 of the user 70 can be enlarged, thereby effectively stretching the leg muscles.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. An elliptical exercising apparatus comprising:

a main frame having a base support adapted to be disposed on the ground, and an upstanding support extending upright from a front end portion of said base support;

a crank assembly including a crank wheel connected rotatably to a rear end portion of said base support, and two crank members connected respectively to two opposite sides of said crank wheel;

two handles connected pivotally and respectively to two opposite sides of said upstanding support;

two rocker arms connected respectively to said handles, each of said rocker arms having an upper connection part and a lower connection part;

two pedal axles, each of which has a front end connected pivotally to said upper connection part of a corresponding one of said rocker arms, and a rear end connected to a corresponding one of said crank members;

two pedal members, each of which is mounted slidably on a corresponding one of said pedal axles; and two connecting arms, each of which has a front end connected to said lower connection part of a corresponding one of said rocker arms, and a rear end connected to a corresponding one of said pedal members.

2. The elliptical exercising apparatus as claimed in claim 1, wherein each of said rocker arms is telescopic, and includes a retractable and extensible section which extends from said upper connection part to said lower connection part.

3. The elliptical exercising apparatus as claimed in claim 2, wherein said front end of each of said connecting arms is pivoted to said lower connection part of the corresponding one of said rocker arms and said rear end of each of said connecting arms is pivoted to a corresponding one of said pedal members.

4. The elliptical exercising apparatus as claimed in claim 1, wherein each of said pedal axles includes a front section and a rear section connected to and forming an angle with said front section, each of said pedal members being mounted slidably on said rear section.

* * * * *